US009289063B2

(12) United States Patent
Baugh et al.

(10) Patent No.: US 9,289,063 B2
(45) Date of Patent: Mar. 22, 2016

(54) CONVERTIBLE HEADBOARD TABLE APPARATUS AND METHOD OF USE

(71) Applicant: Lamplight Development, LLC, Shreveport, LA (US)

(72) Inventors: Gene W. Baugh, Shreveport, LA (US); Jayne A. Baugh, Shreveport, LA (US)

(73) Assignee: Lamplight Development, LLC, Shreveport, LA (US)

( * ) Notice: Subject to any disclaimer, the term of this patent is extended or adjusted under 35 U.S.C. 154(b) by 0 days.

(21) Appl. No.: 14/451,236

(22) Filed: Aug. 4, 2014

(65) Prior Publication Data

US 2014/0338120 A1 Nov. 20, 2014

Related U.S. Application Data

(63) Continuation-in-part of application No. 12/932,147, filed on Feb. 18, 2011, now Pat. No. 8,793,823.

(60) Provisional application No. 61/305,661, filed on Feb. 18, 2010.

(51) Int. Cl.

| | |
|---|---|
| ***A47B 83/04*** | (2006.01) |
| ***A47C 17/58*** | (2006.01) |
| ***A47C 19/02*** | (2006.01) |
| ***A47B 5/06*** | (2006.01) |
| ***A47C 17/62*** | (2006.01) |

(52) U.S. Cl.

CPC . *A47B 83/04* (2013.01); *A47B 5/06* (2013.01); *A47C 17/62* (2013.01); *A47C 19/022* (2013.01)

(58) Field of Classification Search

CPC ..... A47B 83/04; A47B 5/06; A47C 19/022; A47C 17/58; A47C 17/52

USPC ..... 5/635; 267/182, 154, 273; 108/48, 49, 108/65, 172, 69, 162, 166–168

See application file for complete search history.

(56) References Cited

U.S. PATENT DOCUMENTS

| | | | |
|---|---|---|---|
| 244,324 | A | 7/1881 | Sherman |
| 420,187 | A | 1/1890 | Clark |
| 573,909 | A | 12/1896 | Norton |

(Continued)

FOREIGN PATENT DOCUMENTS

| | | |
|---|---|---|
| CN | 2126979 | 2/1993 |
| CN | 2188316 | 2/1995 |

(Continued)

*Primary Examiner* — David E Sosnowski
*Assistant Examiner* — Ifeolu Adeboyejo
(74) *Attorney, Agent, or Firm* — Schultz & Associates, P.C.

(57) ABSTRACT

A wall mounted headboard capable of storing and deploying a spring loaded table. The apparatus is comprised of a headboard pivotally connected to a first table section and assisted by a plurality of gas springs. The first table section is pivotally hinged to a second table section. The hinges between the table sections are hidden thus the table surface is free from anything disturbing a smooth surface. The weight of the second table section is offset by a plurality of torsion spring assemblies. The torsion spring assemblies are comprised of a torsion spring slidingly engaged in brackets mounted to each table section. The torsion spring assemblies allow a single user to move the second table section easily with minimal effort whether deploying or storing the table. The operation of storing or deploying the table can be performed from either side of the bed without walking around to the opposite side.

13 Claims, 10 Drawing Sheets

(56) References Cited

U.S. PATENT DOCUMENTS

| | | | | | |
|---|---|---|---|---|---|
| 577,593 | A | * | 2/1897 | Bronson | 16/293 |
| 808,818 | A | | 1/1906 | Davies | |
| 845,117 | A | | 2/1907 | Peters | |
| 1,095,701 | A | * | 5/1914 | Bronson | 16/296 |
| 1,282,391 | A | | 10/1918 | Donnell | |
| 1,448,788 | A | | 3/1923 | Campbell | |
| 2,073,293 | A | * | 3/1937 | Ybanez et al. | 5/2.1 |
| 2,257,425 | A | | 10/1940 | Mezzetti | |
| 2,572,469 | A | | 6/1946 | Gimmler | |
| 2,566,256 | A | | 5/1949 | Snyder | |
| 2,672,624 | A | * | 3/1954 | Giuseffi | 5/2.1 |
| 2,770,813 | A | * | 11/1956 | Marzillier | 5/2.1 |
| 3,055,018 | A | | 11/1959 | Pink | |
| 3,133,510 | A | | 5/1964 | Maraventano | |
| 3,341,198 | A | | 9/1967 | Turpin | |
| 3,351,960 | A | | 11/1967 | Burkholder | |
| 3,909,857 | A | * | 10/1975 | Herrera | 5/164.1 |
| 3,965,498 | A | * | 6/1976 | Boni | 5/6 |
| 4,005,898 | A | | 2/1977 | Way | |
| 4,047,488 | A | | 9/1977 | Gutridge et al. | |
| 4,195,372 | A | * | 4/1980 | Farina | 4/234 |
| 4,731,904 | A | * | 3/1988 | Sprague | 16/286 |
| 4,793,011 | A | | 12/1988 | Eve | |
| 4,958,392 | A | | 9/1990 | Cannady | |
| 5,475,897 | A | * | 12/1995 | Satoh et al. | 16/291 |
| 5,513,574 | A | | 5/1996 | Collins | |
| 6,460,221 | B1 | * | 10/2002 | Eromaki | 16/286 |
| 6,691,342 | B2 | | 2/2004 | Sherman | |
| 6,974,404 | B1 | * | 12/2005 | Watterson et al. | 482/54 |
| 7,017,200 | B2 | | 3/2006 | Reppas et al. | |
| 2008/0052824 | A1 | | 3/2008 | Stoltzfus | |
| 2010/0107932 | A1 | | 5/2010 | O'Neill | |
| 2010/0237550 | A1 | * | 9/2010 | Kubota | 267/159 |

FOREIGN PATENT DOCUMENTS

| | | |
|---|---|---|
| CN | 2312627 | 4/1999 |
| CN | 2010098282 | 8/2008 |
| ES | 2136026 | 11/1999 |
| GB | 23053 | 0/1912 |
| GB | 211621 | 2/1924 |
| GB | 368428 | 3/1932 |
| GB | 622986 | 5/1949 |
| GB | 797348 | 7/1958 |
| GB | 815663 | 7/1959 |
| GB | 819933 | 9/1959 |
| GB | 2209275 | 5/1989 |
| GB | 16892 | 10/2007 |
| GB | 2440113 | 1/2008 |
| JP | 2007151592 | 6/2007 |

* cited by examiner

CONVERTIBLE HEADBOARD TABLE APPARATUS AND METHOD OF USE

CROSS-REFERENCE TO RELATED APPLICATIONS

This application is a Continuation-In-Part of U.S. patent application Ser. No. 12/932,147, filed Feb. 18, 2011, which claims priority to U.S. Provisional Application No. 61/305,661, filed Feb. 18, 2010. Each patent application identified above is incorporated here by reference in its entirety to provide continuity of disclosure.

FIELD OF THE DISCLOSURE

The present invention relates to convertible furniture. In particular, the invention relates to a wall mounted or free standing headboard having a spring loaded table apparatus which is easily lowered from a concealed position within the headboard to a functional position over a bed to utilize the space adjacent the bedding surface without disturbing the bedding.

BACKGROUND OF THE DISCLOSURE

As a result of today's economy, many people are looking to downsize the footprint of their living spaces. A reality of smaller sized houses and or apartments is that there is less room for furniture. Large tables are often one of the first pieces of furniture to be sacrificed to space saving efforts. Convertible furniture is an efficient way to save floor space and maintain functionality. The temporary need for the large surface that a table provides either for meal time or project time is one example of where space saving features of convertible furniture could be efficiently utilized. It is desirable to have a large table that does not require being stored in a closet.

U.S. Pat. No. 7,017,200 to Reppas, et al. discloses a convertible furniture assembly having a bed frame pivotally coupled to a frame assembly. The assembly contains as bed surface and a table surface and is counterweighted to enable operation by a single user. However, the bedding surface needs to be removed in order to function as a table and the table working surface is smaller than the bedding surface therefore not maximizing efficiency and losing functionality.

U.S. Pat. No. 6,691,342 to Sherman discloses a convertible furniture unit having a base and a pivotally connected bed platform. Once the bed platform moves to a stored position, a table panel pivotally connected to the underside of the bed platform is propped into place by a spring loaded or linear actuated extension. While the furniture piece may be operated by a single user, the bedding surface must be prepped for stowage and the resulting work surface of the table is significantly smaller than the bedding surface it replaces. Additionally, the bedding surface is custom to this particular piece of furniture and cannot be utilized elsewhere.

U.S. Pat. No. 2,566,256 to Snyder discloses a two section, folding cabinet table top. The resulting table top is capable being deployed by a single user, but the table top takes up more floor space that the cabinet alone and the table surface is hindered by hinges thus is limited in functionality.

U.S. Pat. No. 845,117 to Peters discloses a combination bed and table apparatus. The apparatus cannot accommodate a standard bed frame, the bedding material must be removed and stored separately, and the crank used to position the table surface in place does not significantly offset the weight of the table surface.

There is a need for convertible furniture that can be easily operated by one user, does not require any prepping of the converted area, does not require any rearrangement of the current furniture, is compatible with existing furniture, provides a surface that maximizes the space where the furniture sits, is completely functional whatever formation is being utilized, and does not require extra storage space.

SUMMARY

The preferred embodiment combines a bed headboard capable of accepting a standard bedframe and mattress that converts to a sturdy, completely unencumbered work surface that utilizes the entire space provided by the sleeping surface without the need for rearranging or removing bedding. The preferred embodiment is operable by a single user with minimal effort and is also aesthetically pleasing.

Accordingly, an embodiment of the apparatus includes a headboard connected to a standard bed frame and mattress in a conventional manner. A folded table surface is pivotally connected to the headboard and, when not in use, completely stored therein out of sight behind a panel and a pair of wing doors. A pair of gas springs enables a single user to lower the folded table surface out of the stored position from within the headboard with minimal effort. The table surface is comprised of two table sections pivotally connected to each other. Each table section includes a pair of connected table legs. A torsion spring assembly connected to each table section allows a single user to separate the table sections and unfold to form the complete table surface on top of the existing bedding surface without disturbing the bedding surface. The table surface is unencumbered by connecting hardware and thus provides a completely smooth and uninterrupted work or eating surface. The table surface is also larger than the bedding surface and thus there is room to comfortably stand next to the table surface. The torsion springs offset the weight of the table section and therefore also assist in the stowing of the table surface. The complete setting up of the table surface and the stowing of the table surface can be performed by a single user and completely from one side of the bed.

In alternate embodiments, the gas springs can be replaced by linear actuators for powered operation.

Those skilled in the art will appreciate the above-mentioned features and advantages of the invention together with other important aspects thereof upon reading the detailed description that follows in conjunction with the drawings provided.

BRIEF DESCRIPTION OF THE DRAWINGS

In the detailed description of the preferred embodiments presented below, reference is made to the accompanying drawings, which are incorporated in the specification hereof by reference, wherein.

DETAILED DESCRIPTION OF THE PREFERRED EMBODIMENT

Figure 1:
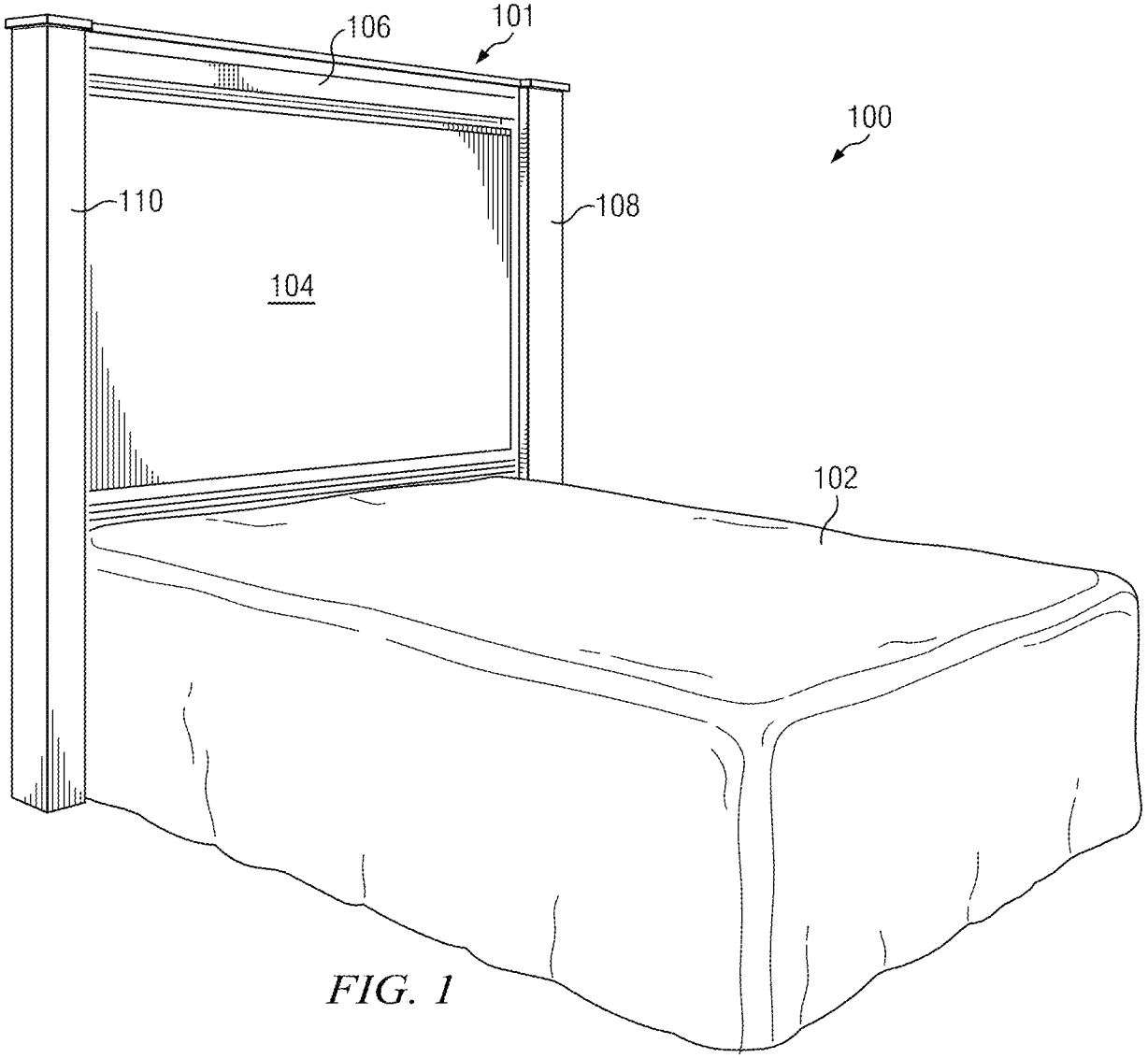
FIG. 1 is a perspective view of a preferred embodiment where the table apparatus is stored.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Referring to FIGS. 1-4, headboard/table apparatus 100 is comprised of headboard 101 mounted to a wall and bed 102 secured to headboard 101 in a manner that is common in the art. Headboard/table apparatus is preferably made of decorative wood but could also be formed from injection molded plastic or polyvinyl chloride (PVC). Headboard 101 is comprised of two columns configured with wing doors 108 and 110 connected by backboard 128. Wing doors 108 and 110 each pivot about a vertical axis through the use of piano hinges or other hinges equivalent in the art. Headboard 101 further includes frame 106 which is fixed to backboard 128. In an alternate embodiment, backboard 128 is not necessary and frame 196 connects wing doors 108 and 110. Panel 104 is affixed to the underside of first table section 120 creating a torsion box. In addition to providing structural support for first table section 120, when headboard/table apparatus 100 is in a stored position, panel 194 hides the table sections from sight. Panel 104 is slightly less wide than first table section 120 which allows access to supporting leas. Panel 104 includes lip 125 which extends through the full width of the upper edge of panel 104. Frame 106 surrounds and frames panel 104 on all four sides. The face of panel 104 is decorative and can include any design, wood finish, or padding that is desirable. Wing doors 108 and 110 are releasably latched to frame 106 through the use of magnets or plastic catch pins or an equivalent method common in the art.

In the stored position, sandwiched in between backboard 128 and panel 104 are first table section 120 and second table section 122. First table section 120 is pivotally mounted to headboard 101 at mount points 120A and 120B using pivot bolts or equivalent pivoting hardware common in the art. Second table section 122 is hinged to first table section 120 with a plurality of hinges 132. Gas spring 130 connects first table section 120 to headboard 101 and is located near pivot point 120A. An identical gas spring connects first table section 120 to bead board 101 near pivot point 120B. The gas springs help to offset the weight of the table sections during deployment. In the preferred embodiment, the gas springs are capable of providing approximately 100 to 140 lbs. of force with the preferred being 120 lbs. of force each when compressed. An example is part no. GGS24-120-K available from H.A. Guden Co., Inc. In an alternate embodiment, the gas springs could be replaced by coil springs or in an additional alternate embodiment linear actuators could be incorporated for a completely powered deployment. First table section 120 further includes legs 124 and 126. Legs 124 and 126 are connected together by bar 138 so that moving one leg moves the other leg simultaneously. Bar 138 is rotationally mounted in mounting brackets at end 135. Spring loaded pins 137 pass through each mounting bracket and each leg to secure each leg in the extended position. In an alternate embodiment, only one spring pin is used only through leg 124. Second table section 122 further includes legs 144 and 146. Legs 144 and 146 are also connected by a bar at end 136 so that moving one also moves the other simultaneously. Legs 144 and 146 are also secured in place by one or a pair of spring loaded pins in an identical fashion as legs 124 and 126. Additionally, torsion spring assemblies 140 and 142 are mounted to both first table section 120 and second table section 122. Torsion spring assemblies 140 and 142 are identical in shape and function. As depicted, torsion spring assemblies 140 and 142 are mirror images of each other but would perform equally well if both were oriented in identical manners. In alternate embodiments, the use of one torsion spring assembly would suffice as would the use of more than two.

Referring now to FIGS. 5-9, each torsion spring assembly is comprised of one torsion spring 500 and a pair of mounting brackets 520. In the preferred embodiment, torsion spring 500 is comprised of spring wire between about 0.1 inch to 0.3 inch having a circular cross-section and a spring constant of about 1.0 lbs./degree to about 6.0 in. lbs./degree with the preferred diameter being about 0.25 inches with a preferred spring constant being about 3.8 in. lbs./degree. In alternate embodiments, the cross-section of torsion spring 500 could be any variant of polygonal shapes and could be smaller or larger depending on desired use and spring constant required. In the preferred embodiment each torsion spring provides force according to the following table:

| Degrees of Deployment | Torsion Force |
|---|---|
| −90° | 3.46 in. lbs./degree |
| 0° | 0 in. lbs./degree |
| +90° | 3.46 in. lbs./degree |

Each torsion spring 500 is comprised of three sections. First end section 502 is generally perpendicular to middle section 504 forming a generally 90° angle in a first plane. Second end section 506 is also generally perpendicular to middle section 504 also forming a generally 90° angle but in a second plane. The first plane is generally perpendicular to the second plane. In the preferred embodiment, first and second end sections 502 and 506 are approximately five inches in length while middle section 504 should be at least twice as long as each end section. Dimensions of the torsion springs can be varied as will be apparent to those of skill in the art. In an alternate embodiment, the torsion spring could be replaced with a coil spring.

Mounting bracket 520 is comprised of braces 522 and 524 integrally formed or welded together at a generally perpendicular orientation. Brace 522 includes integrally formed receiving cylinder 526 on one edge and in the preferred embodiment, has a length of approximately three to three and a half inches. Receiving cylinder 526 runs the full length of the edge of brace 522 and includes passage 528 so that receiving cylinder 526 is generally hollow along its length. Brace 522 further includes a circular opening 150 for receiving bar 138 to which bar 138 is rotationally seated within. A plurality of mounting holes 530 are located through both braces 522 and 524 in order to mount the braces to ribs 134 and ends 135 and 136. In a preferred embodiment, mounting bracket 520 is constructed of 11-gauge steel and is attached by screws, bolts, or a suitable adhesive as known in the art.

Figure 10:
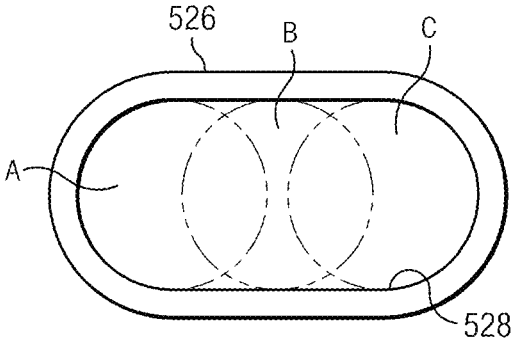
FIG. 10 is a partial plan view of a preferred embodiment of the torsion spring mounting bracket

FIG. 10 shows a cross-section of receiving cylinder 526. Receiving cylinder 526 and correspondingly passage 528 has an ellipsoidal cross sectional shape. Passage 528 has a height that corresponds with the diameter of torsion spring 500 and a width of approximately twice the height which allows torsion spring 500 to slide laterally during operation of headboard/table apparatus 100. Torsion spring 500 is shown in shadow as it moves from position A (table sections folded adjacent to one another) to position B (table sections approximately perpendicular to each other during deployment) to position C (table sections fully deployed).

Figure 4A:
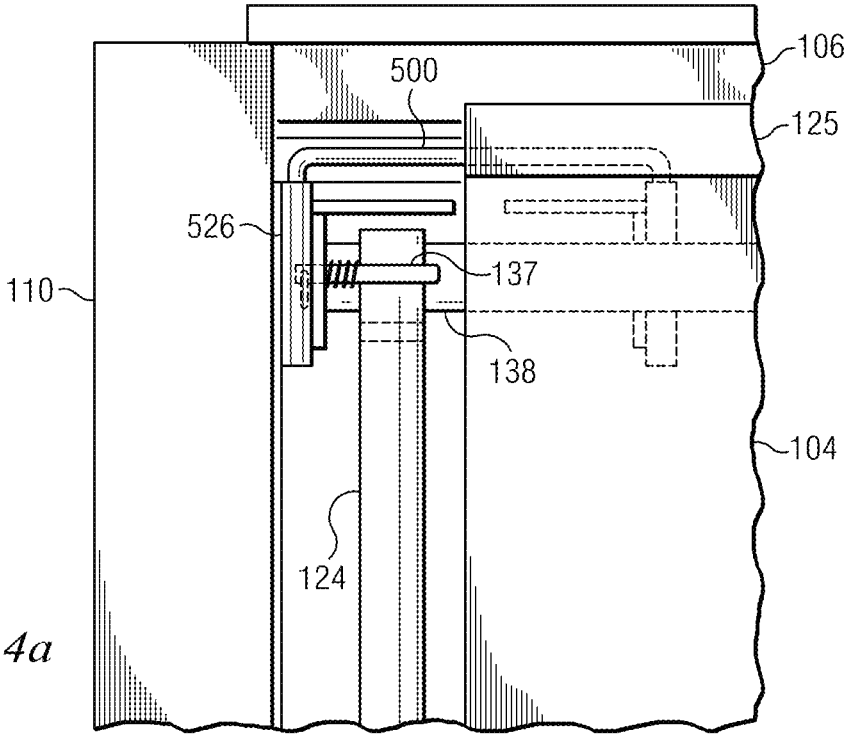
FIG. 4*a* is a partial plan view of a preferred embodiment of the table sections stored in the headboard showing the wing door open.
Figure 4B:
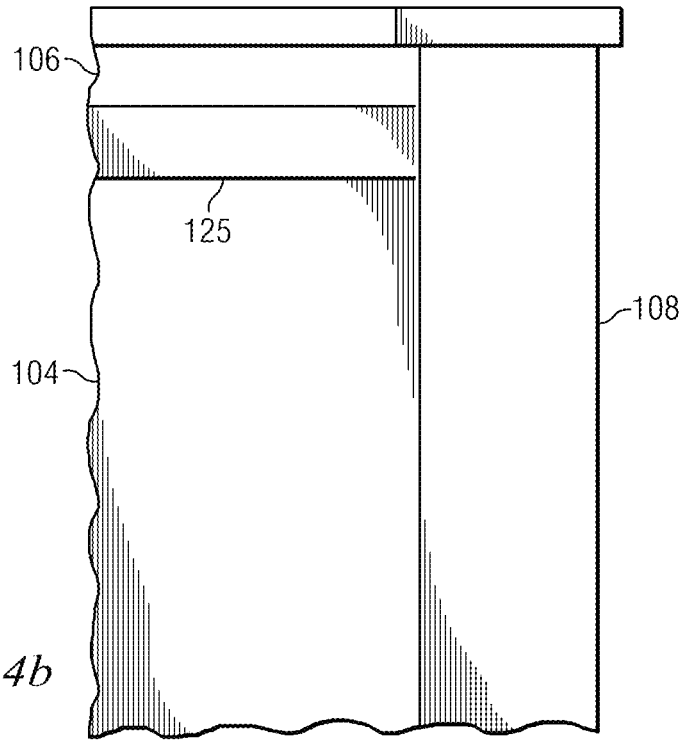
FIG. 4*b* is a partial plan view of a preferred embodiment of the table sections stored in the headboard showing the wing door closed.
Figure 5:
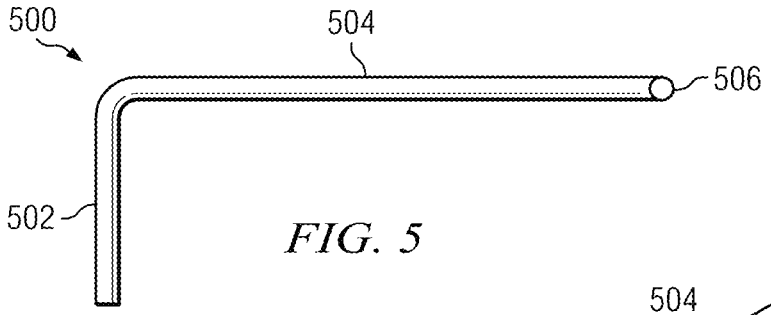
FIG. 5 is a plan view of a preferred embodiment of the torsion spring.
Figure 6:
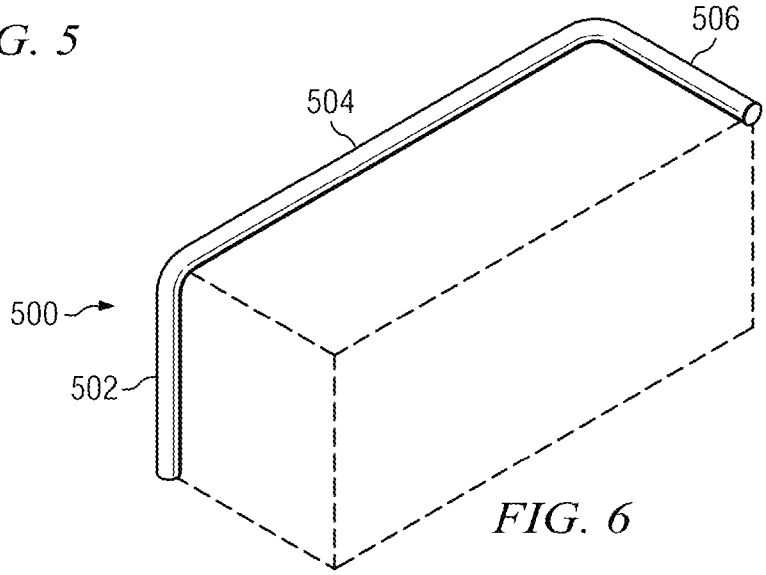
FIG. 6 is a perspective view of a preferred embodiment of the torsion spring.
Figure 7:
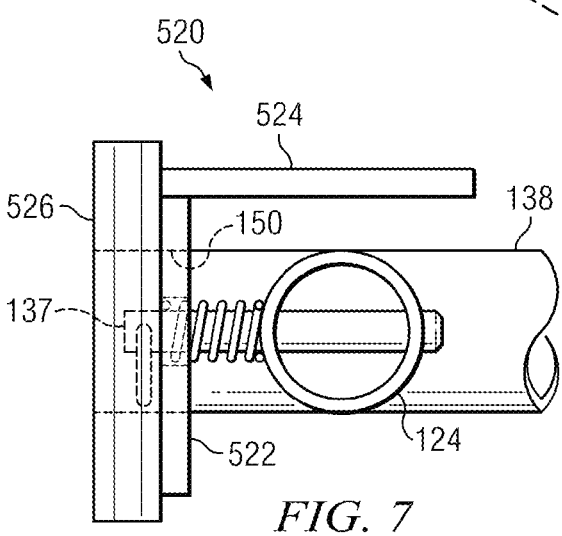
FIG. 7 is a bottom view of a preferred embodiment of the torsion spring mounting bracket with leg extended.
Figure 8:
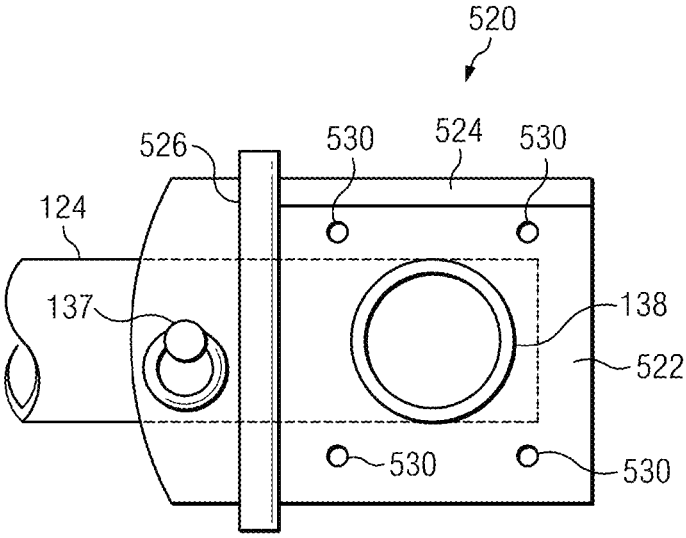
FIG. 8 is a first plan view of a preferred embodiment of the torsion spring mounting bracket with leg extended.
Figure 9:
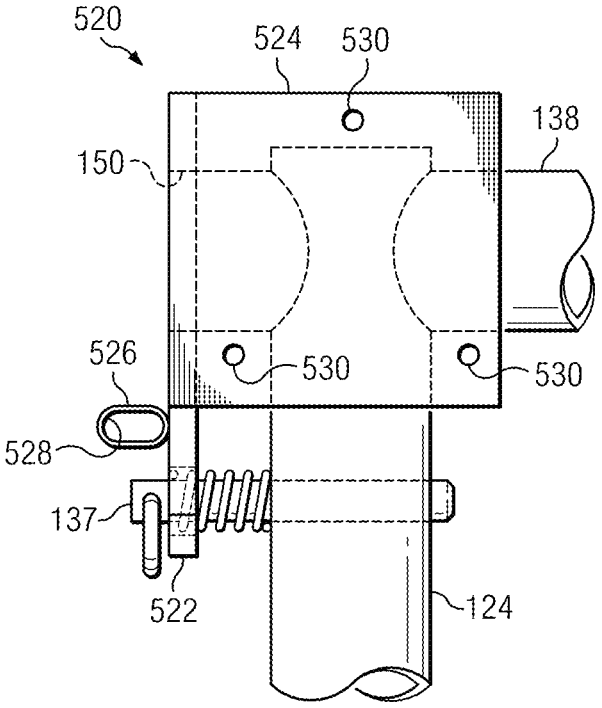
FIG. 9 is a second plan view of a preferred embodiment of the torsion spring mounting bracket with leg extended.

In use, headboard/table apparatus 100 is most naturally found in two states, a table stored state or a table fully deployed state. In the table stored state, as depicted in FIG. 1, the table is completely out of sight and stored in the headboard while the bed is available for use. Panel 104 is decorative and discreetly hides the folded away table sections. In the table fully deployed state, as depicted in FIG. 4, the table comfortably straddles the bed in the space directly above the bedding surface without an accommodation or need to move or store parts of the bed and provides a smooth table top free of hinges or connecting hardware.

FIGS. 11-16 show the torsion spring assemblies mounted to the table sections and how torsion spring 500 operates during the deployment of the table.

Figure 2:
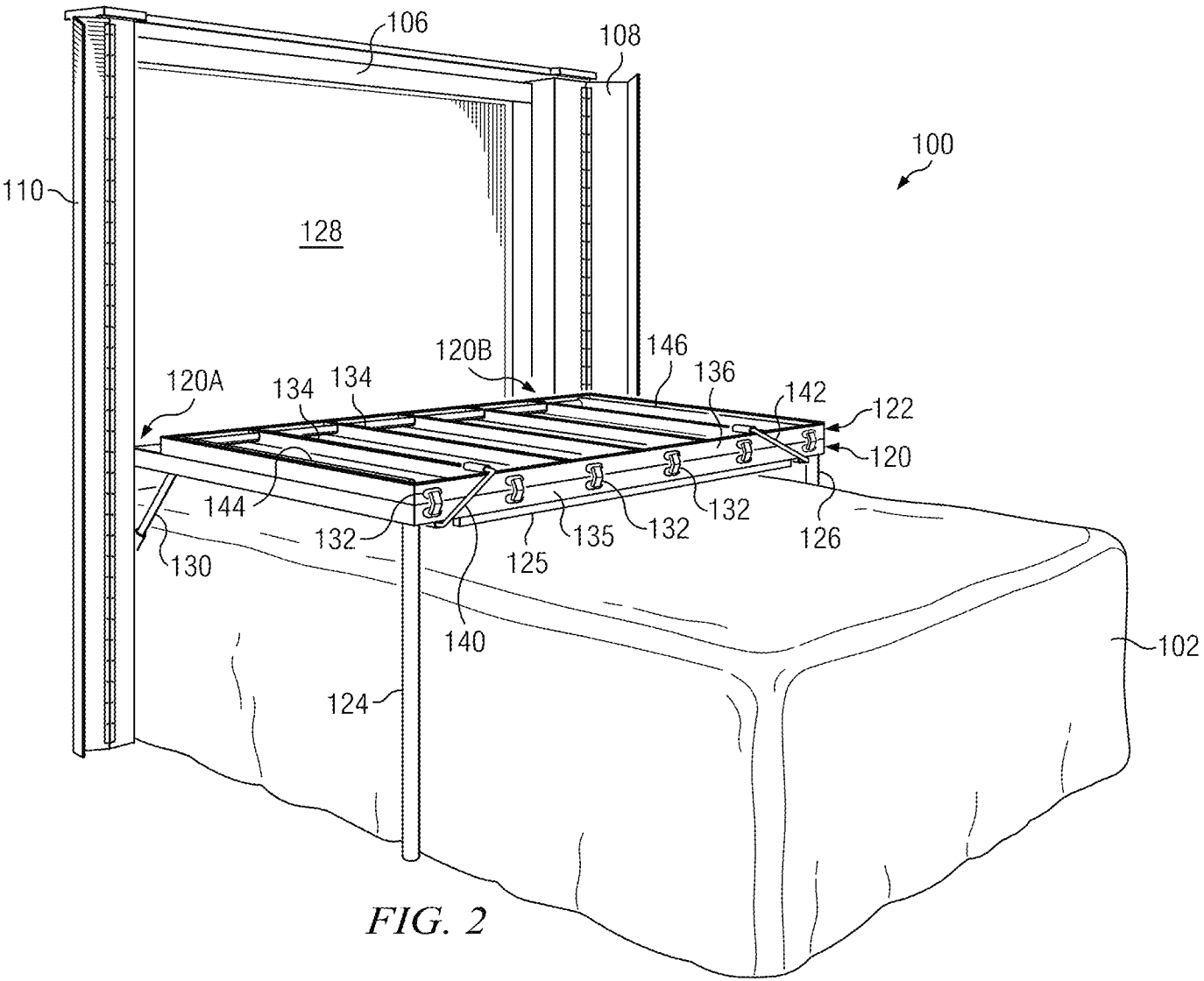
FIG. 2 is a perspective view of a preferred embodiment where the table apparatus is partially deployed.
Figure 11:
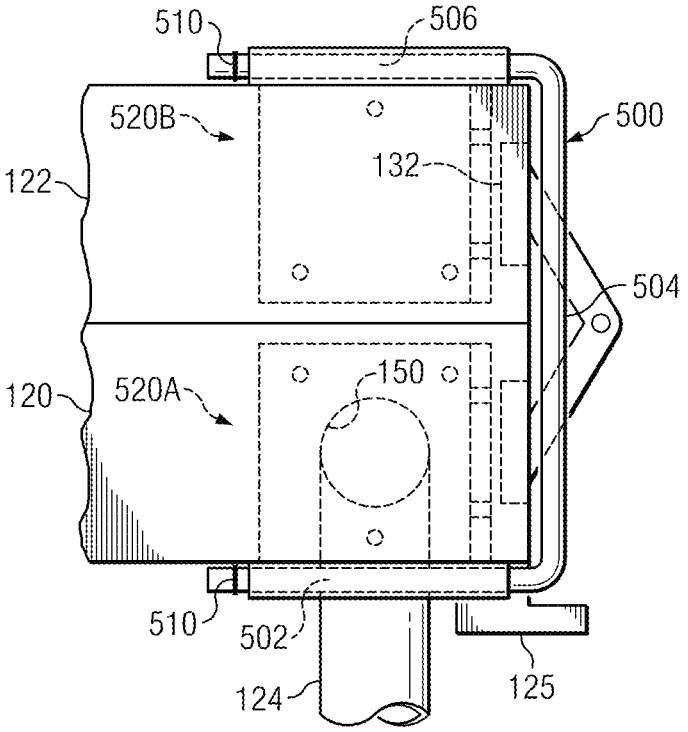
FIG. 11 is a first partial plan view of a preferred embodiment of the two table sections adjacent each other before deployment.
Figure 14:
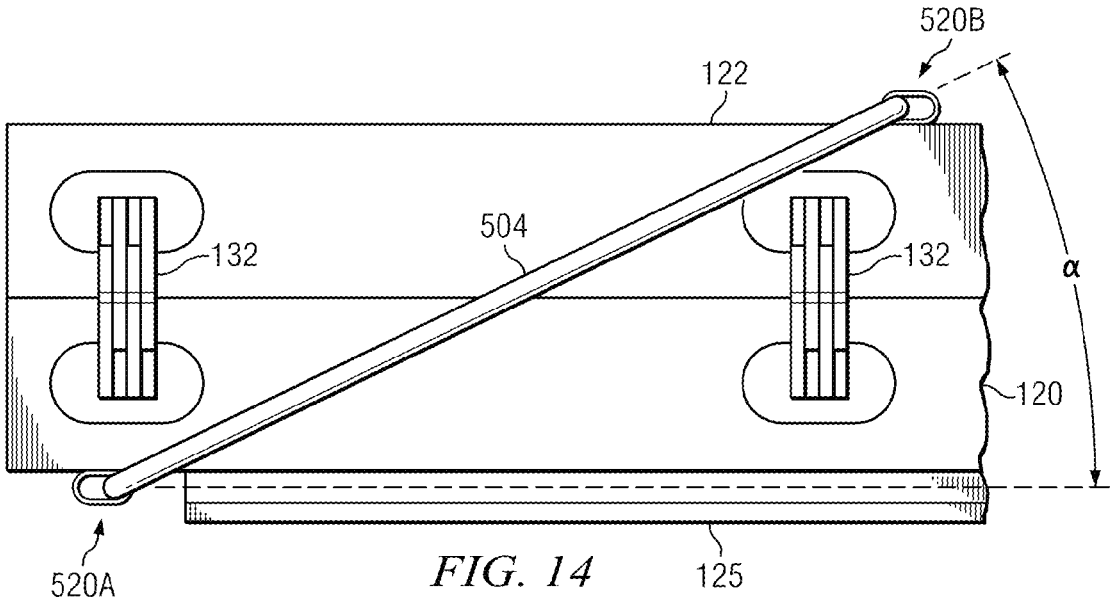
FIG. 14 is a second partial plan view of a preferred embodiment of the two table sections adjacent each other before deployment

FIGS. 11 and 14 show two plan views of mounting bracket 520A mounted to first table section 120 and mounting bracket 520B mounted to second table section 122 where first table section 120 is adjacent to second table section 122. This is the position of the table sections relative to each other when they are in the stored state as in FIG. 1 and as depicted in FIG. 2. End section 502 is slidingly seated in the passage of mounting bracket 520A. End section 506 is slidingly seated in the passage of mounting bracket 520B. End sections 502 and 506 extend through mounting brackets 520A and 520B approximately ½ inch to an inch and self locking retaining rings 510 are affixed to each to prevent torsion spring 500 from backing out of the mounting brackets. Torsion spring 500 is under a torsional force which tends to separate the table sections and pivot second table section 122 away from first table section 120 about the pivoting axes of hinges 132. This torsional force also helps a user to lift and separate second table section 122 from first table section 120. In addition to self locking retaining rings 510, the resultant friction between the inside surface of the receiving cylinders and the outer surface of end sections 502 and 506 prohibits torsion spring 500 from backing out of the respective torsion spring assemblies.

Figure 12:
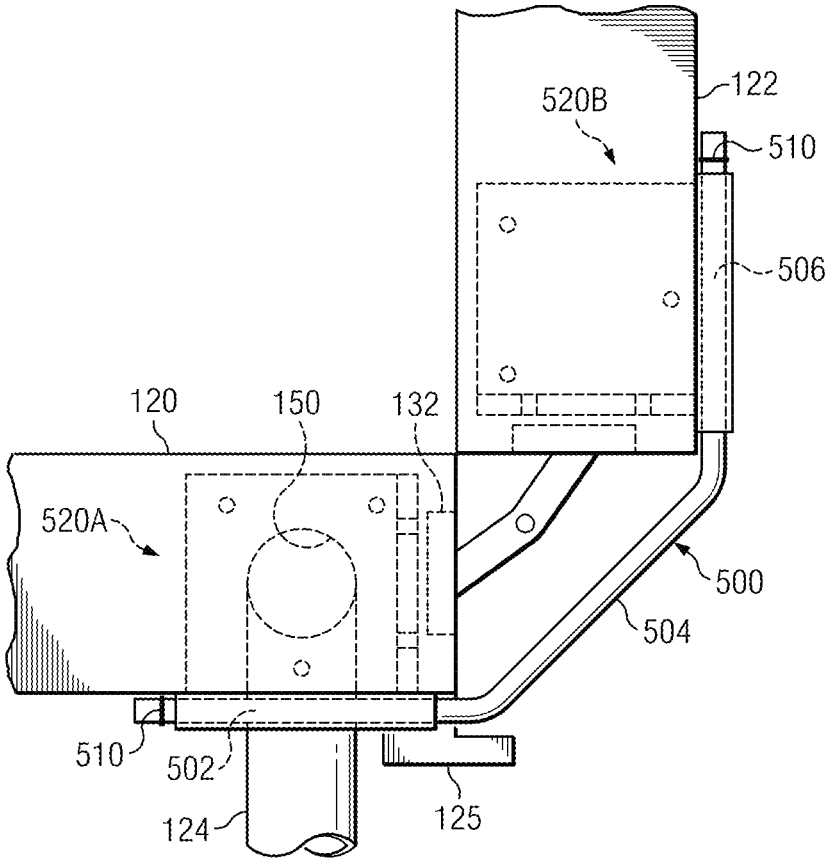
FIG. 12 is a first partial plan view of a preferred embodiment of the two table sections during deployment.
Figure 15:
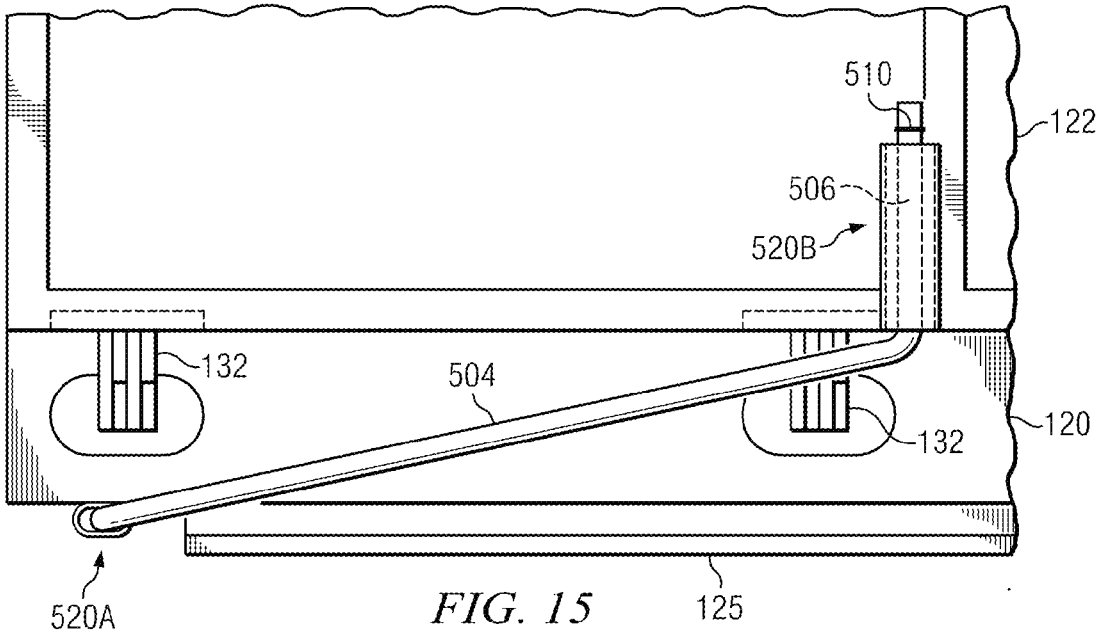
FIG. 15 is a second partial plan view of a preferred embodiment of the two table sections during deployment

FIGS. 12 and 15 show two plan views of mounting bracket 520A mounted to first table section 120 and mounting bracket 520B mounted to second table section 122 where first table section 120 is generally perpendicular to second table section 122. In this position, torsion spring 500 has returned to a generally "at rest" state. Self locking retaining rings 510 prevent torsion spring 500 from backing out of the mounting brackets.

Figure 3:
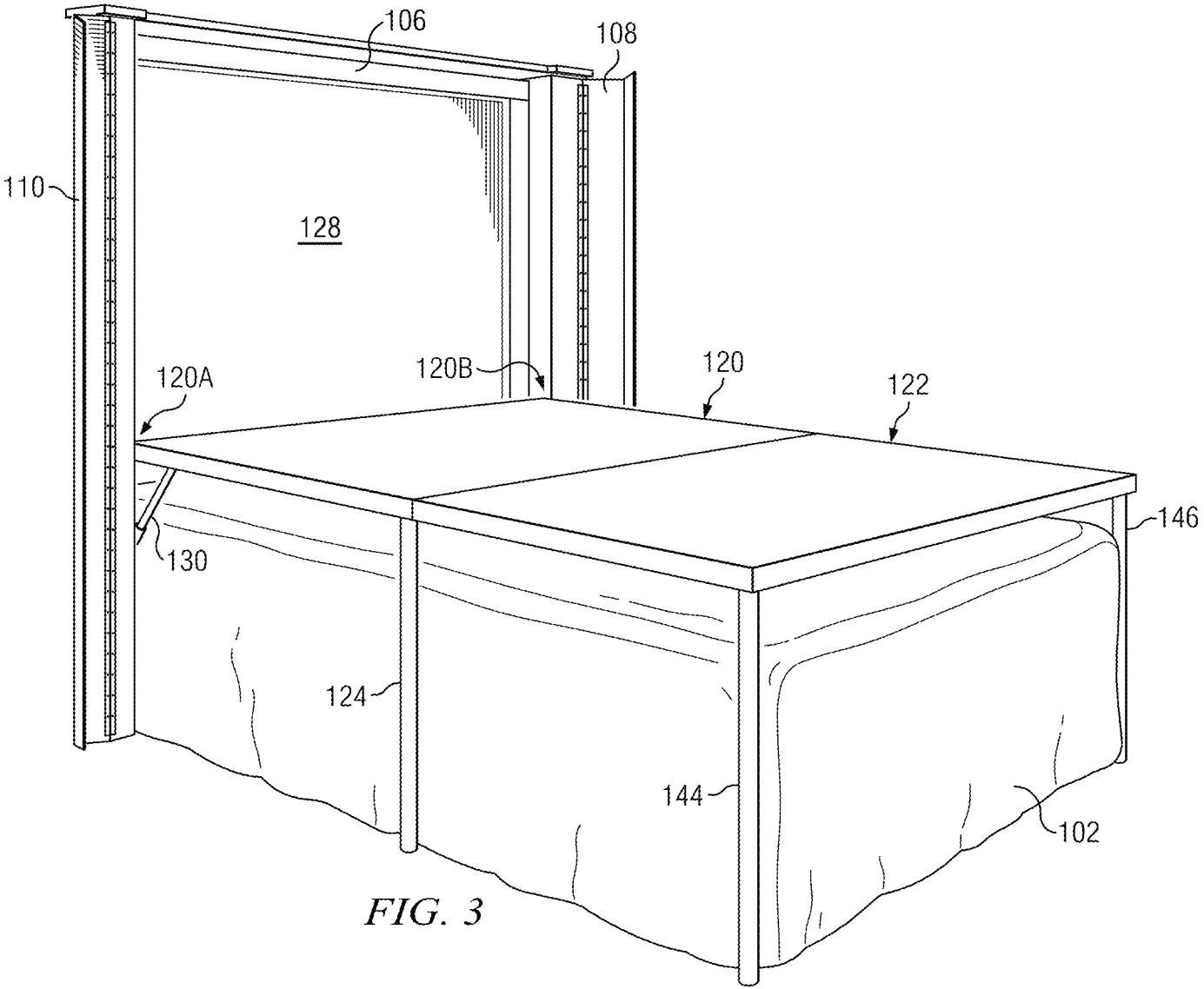
FIG. 3 is a perspective view of a preferred embodiment where the table apparatus is fully deployed.
Figure 13:
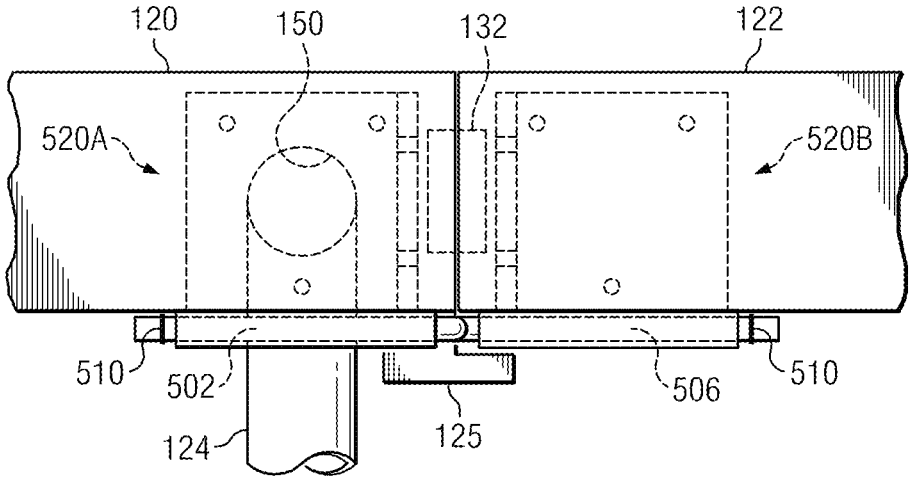
FIG. 13 is a first partial plan view of a preferred embodiment of the two table sections fully deployed.
Figure 16:
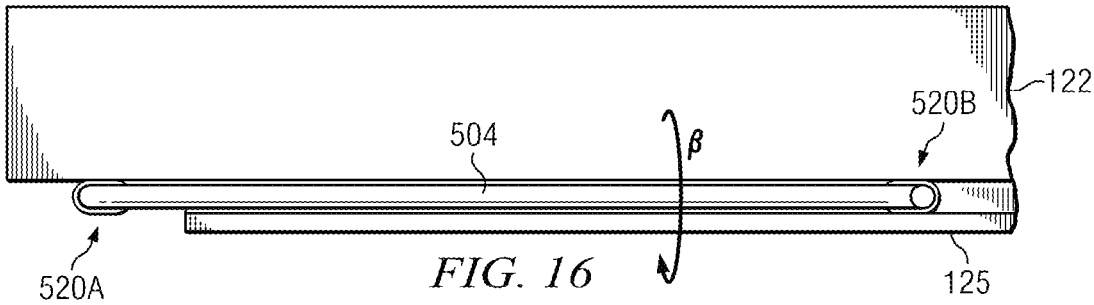
FIG. 16 is a second partial plan view of a preferred embodiment of the two table sections fully deployed.

FIGS. 13 and 16 show two plan views of mounting bracket 520A mounted to first table section 120 and mounting bracket 520B mounted to second table section 122. This is the position of the table sections relative to each other when the are in the fully deployed state occupying the space adjacent the bedding surface as depicted in FIG. 3. Second table section 122 is lowered into place, pivoted about hinges 132 to a position where first table section 120 and second table section 122 are adjacent and on the same plane providing a smooth table top. The torsion spring both translates and rotates during this motion. The torsion spring translates through an angle of between about 15° and about 25° measured from the base of table section 120 as indicated by angle $\alpha$. The torsion spring rotates about its long axis through an angle of about 180° as indicated by $\beta$. A torsional force builds in torsion spring 500 as second table section 122 is lowered into position. This torsional force helps offset the weight of second table section 122. Additionally, self locking retaining rings 510 and the resultant friction between the receiving cylinders of mounting brackets 520A and 520B and end sections 502 and 506 respectively prevent torsion spring 500 from backing out of the mounting brackets.

Changing headboard/table apparatus 100 between the stored state and the fully deployed state requires only one user. The weight of the table sections is always supported by either gas springs 130, a plurality of torsion springs 500, or a combination of both. In the preferred embodiment, second table section 122 weighs approximately 35 to 40 lbs. and with torsion spring 500 in place, the resultant lifting weight is approximately five lbs. or less. The first step in moving from the stored state to the fully deployed state is opening wing doors 108 and 110. Once the wing doors are pivoted open about their respective piano hinges, first table section 120 and second table section 122 are lowered together from a vertical position to a generally horizontal position. Gas springs 130 help support the combined weight of the table sections as they are lowered. Once in the generally horizontal position, legs 124 and 126 are pivoted from underneath first table section 120 and locked into place via pins 127. Legs 124 and 126 are positioned generally perpendicular to the floor and to first table section 120. Since legs 124 and 126 are actuated together, this operation can take place on one side of the bed without having to switch sides mid-operation. Next, second table section 122 is lifted off of first table section 120 and pivoted about hinges 132. Torsion spring assemblies 140 and 142 assist in the lifting of second table section 122 by offsetting the weight of the table section thereby requiring a minimal force to lift the table section. Once second table section 122 moves past a vertical position, torsion spring assemblies 140 and 142 assist in lowering second table section into place by once again offsetting the weight of second table section 122 so that a minimal force is required. When second table section 122 is in a generally horizontal position, legs 144 and 146 are pivoted from underneath second table section 122 and locked into place via spring loaded pins in an identical manner as legs 124 and 126. Legs 144 and 146 are positioned generally perpendicular to the floor and to second table section 122. Since legs 144 and 146 are also actuated together, this operation can take place on the same side of the bed as the lowering of legs 124 and 126. The apparatus is now in the fully deployed state and the smooth table top is ready for use in the space adjacent the bedding surface. Neither the bed itself nor the bedding required movement or rearranging during the deployment of the apparatus.

Figure 17:
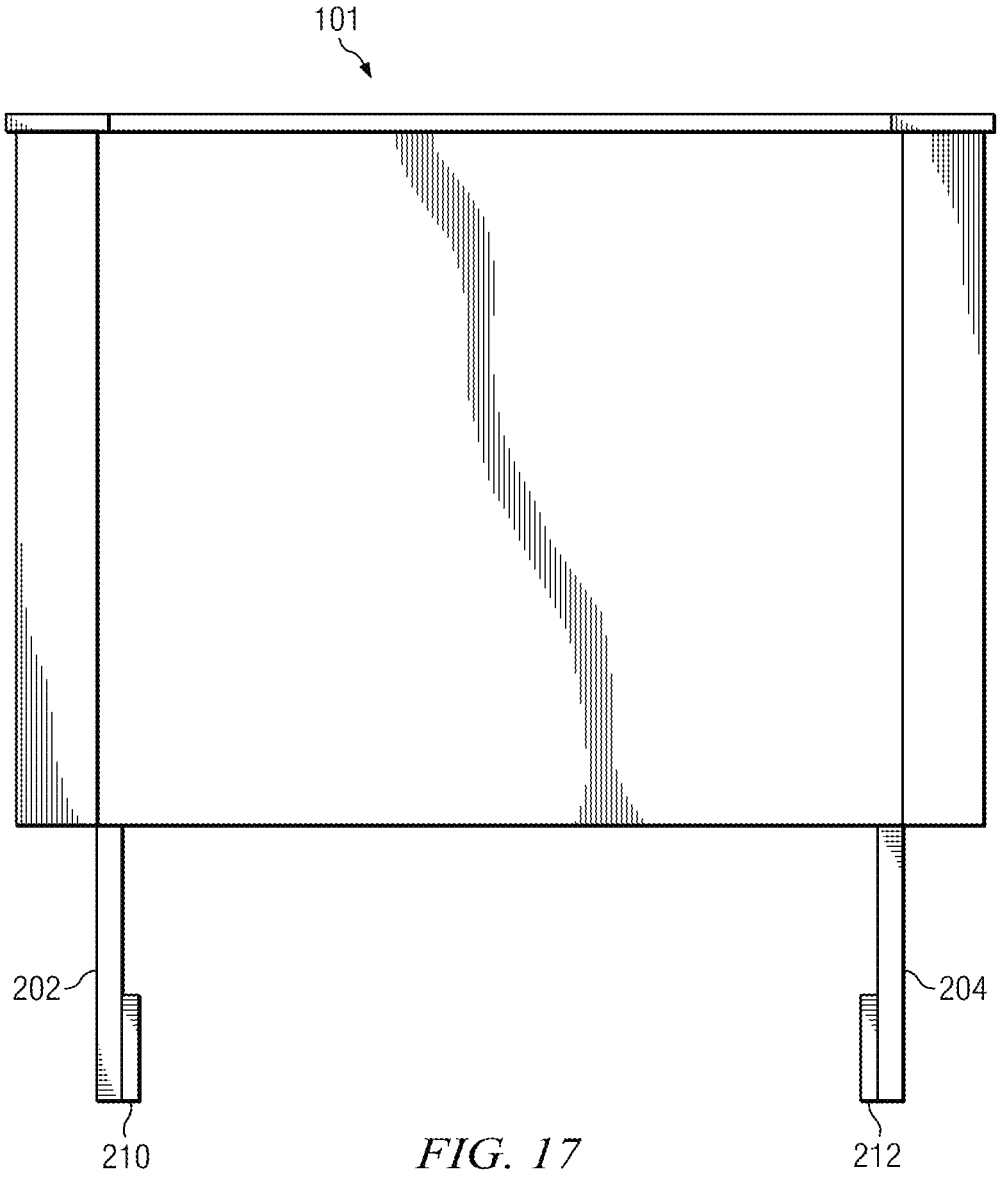
FIG. 17 is a plan view of an alternate preferred embodiment.

An alternate embodiment of headboard/table apparatus 100 is shown in FIG. 17. Headboard 101 is mounted to the bed frame of bed 102 instead of mounted directly to the wall. Braces 202 and 204 extend from the bottom edge of headboard 101 and are mounted to bed 102 via a pair of L-brackets 210 and 212.

Figure 18:
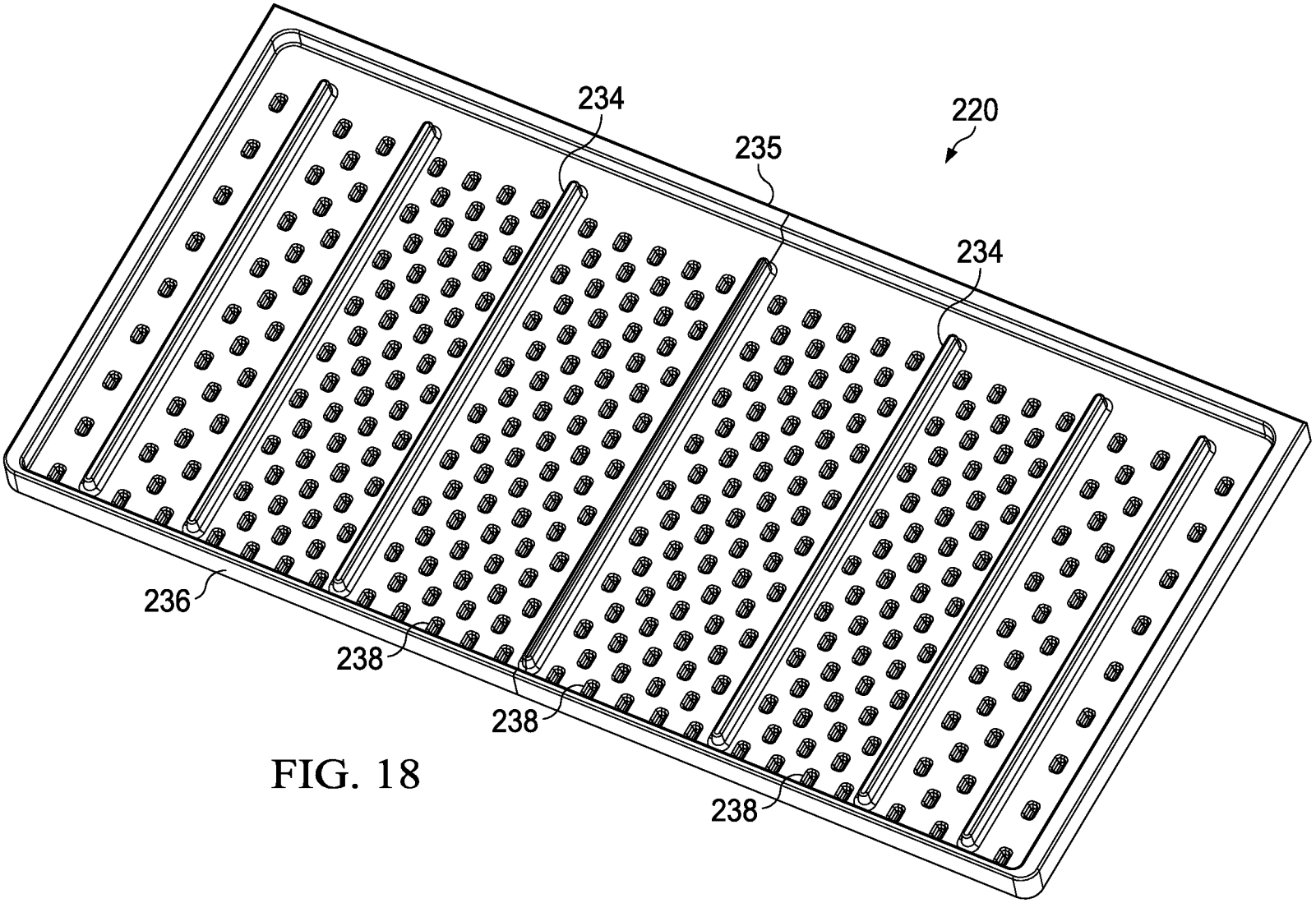
FIG. 18 is a perspective view of an alternate preferred embodiment of a table section.

An alternate embodiment of a table section is shown in FIG. 18. Table section 220 is comprised of injection molded plastic or polyvinyl chloride (PVC). Table section 229 includes a plurality of generally parallel ribs 234 positioned generally perpendicular to ends 235 and 236. End 235 includes squared corners and receives the mounting brackets. Spaced between ends 235 and 236 and the plurality of ribs 234 are depressions 238. Depressions 238 are hollows formed in the underside of table section 220. Depressions 238 reduce the overall weight of table section 220 without affecting strength. Depressions 238 do not continue to the topside of table section 220 thus the desired smooth table top is maintained. Depressions 238 can be any known shape such as round, oval, rectangular, etc. Further, depressions 238 can be deployed in any known pattern or in random positions and orientations. In an alternate embodiment, table section 220 is manufactured by blow molding. In this embodiment, the table section is largely hollow and extremely lightweight.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method for deploying a concealable table from a headboard connected to a bed comprising the steps of:

exposing a first table section, where the first table section is hinged to a second table section and where the first table section is pivotally attached to the headboard;

rotating the first table section and the second table section away from the headboard while compressing a compression spring;

pivoting a first set of legs away from the first table section;

rotating the second table section away from the first table section while de-tensioning a linear torsion spring, where the linear torsion spring biases the second table section away from the first table section;

further rotating the second table section away from the first table section while tensioning the linear torsion spring, where the linear torsion spring at least partially offsets the weight of the second table section; and, rotating a second set of legs away from the second table section.

2. The method of claim 1 wherein the step of de-tensioning the linear torsion spring further comprises the steps of:

rotating the linear torsion spring; and, translating the linear torsion spring.

3. The method of claim 1 wherein the step of de-tensioning the linear torsion spring further comprises the step of:

rotating the linear torsion spring through a first generally 90° angle.

4. The method of claim 3 wherein the step of tensioning the linear torsion spring further comprising the step of:

rotating the linear torsion spring through a second generally 90° angle.

5. The method of claim 1 wherein the step of pivoting the first set of legs includes the step of unlocking the first set of legs from a fixed position.

6. The method of claim 1 wherein the step of rotating the second table section away from the first table section while de-tensioning the linear torsion spring comprises exerting less than five pounds of force.

7. The method of claim 1 wherein the step of further rotating the second table section away from the first table section while tensioning the linear torsion spring comprises exerting less than five pounds of force.

8. A method for utilizing the space above a bed with a concealable table in a headboard comprising the steps of:

providing a hinged table, having a first table section pivotally attached to a second table section, pivotally attached to the headboard;

providing a torsion spring slidingly attached to the first table section and slidingly attached to the second table section;

pivoting the hinged table away from the headboard to adjacent the bed;

rotating a first leg set away from the first table section;

rotating the second table section away from the first table section and releasing a first torsional force in the torsion spring;

further rotating the second table section away from the first table section and creating a second torsional force in the torsion spring to adjacent the bed;

rotating a second leg set away from the second table section; and, thereby providing a flat working surface for utilizing the space above the bed without disturbing the bed.

9. The method of claim 8 where the step of releasing the first torsional force is unwinding the torsion spring.

10. The method of claim 8 where the step of creating the second torsional force is winding the torsion spring.

11. The method of claim 8 wherein the step of releasing the first torsional force comprises the further steps of:

rotating the torsion spring; and, translating the torsion spring.

12. The method of claim 8 wherein the step of releasing the first torsional force is rotating the torsion spring through a first generally 90° angle.

13. The method of claim 12 wherein the step of creating the second torsional force is rotating the torsion spring through a second generally 90° angle.

* * * * *